US011951379B1

(12) United States Patent
Ryan et al.

(10) Patent No.: US 11,951,379 B1
(45) Date of Patent: Apr. 9, 2024

(54) SKI POLE WITH PERSONAL SAFETY PERIMETER INDICATOR

(71) Applicant: SETBC, LLC, San Diego, CA (US)

(72) Inventors: Robert Ryan, Mission Viejo, CA (US); Michelle Baccaro, Mission Viejo, CA (US)

( * ) Notice: Subject to any disclaimer, the term of this patent is extended or adjusted under 35 U.S.C. 154(b) by 0 days.

(21) Appl. No.: 18/122,119

(22) Filed: Mar. 15, 2023

(51) Int. Cl.
*A63C 11/22* (2006.01)

(52) U.S. Cl.
CPC ..... *A63C 11/228* (2013.01); *A63C 11/227* (2013.01)

(58) Field of Classification Search
CPC .... A63C 11/225; A63C 11/227; A63C 11/228
See application file for complete search history.

(56) References Cited

U.S. PATENT DOCUMENTS 5,359,797 A * 11/1994 Williamson ..... G09F 11/29 40/904
5,390,957 A * 2/1995 Metzler ..... A63C 11/00 40/904
5,538,285 A * 7/1996 Goode ..... A63C 11/22 280/821
8,235,424 B2 * 8/2012 Garcia ..... A63C 11/228 280/819
11,013,981 B1 * 5/2021 OWinter ..... A63C 11/228

* cited by examiner

*Primary Examiner* — Brian L Swenson
(74) *Attorney, Agent, or Firm* — Joshua C. Harrison, Esq.; Barcelo, Harrison & Walker LLP

(57) ABSTRACT

A novel perimeter indication rod assembly includes a perimeter indication rod for pivotal connection to a ski pole by a rod positioning mechanism. The rod positioning mechanism is configured to selectively hold the perimeter indication rod in extended or stowed position. The distal extent of the perimeter indication rod visually indicates a desired lateral safety distance from the skier.

20 Claims, 10 Drawing Sheets

SKI POLE WITH PERSONAL SAFETY PERIMETER INDICATOR

BACKGROUND

Skiers generally direct their attention downhill, and so are often unaware of faster or overtaking skiers or snowboarders approaching from behind. Therefore, according to skiing rules and etiquette, a skier who is further downhill has right of way relative to a skier who is further uphill. Still, it can be undesirably dangerous or startling for a downhill skier if another skier or snowboarder passes by too closely, e.g., without enough lateral space as a safety margin to ensure a collision is avoided. Hence, there is a need in the art for a practical method or apparatus to reduce the risk that a downhill skier will be passed with insufficient safety margin for collision avoidance.

DETAILED DESCRIPTION OF EXEMPLARY EMBODIMENTS

Figure 1:
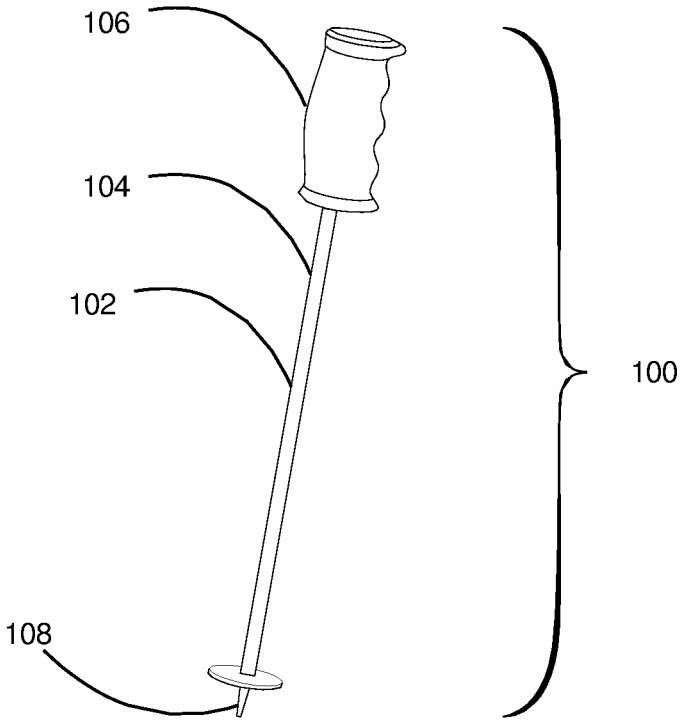
FIG. 1 depicts a conventional ski pole assembly into which an aftermarket embodiment of the present invention may be incorporated or attached.

FIG. 1 depicts a conventional ski pole assembly 100 into which an embodiment of the present invention may be incorporated by design prior to manufacture, or to which an aftermarket embodiment of the present invention may be attached after manufacture. The ski pole assembly 100 includes a pole 102 that has an upper portion 104 and a lower end 108. The ski pole assembly 100 also includes a handle 106 that is attached to the upper portion 104 of the pole 102. The pole 102 may have a slight taper from the upper portion 104 to the lower end 108.

Figure 2A:
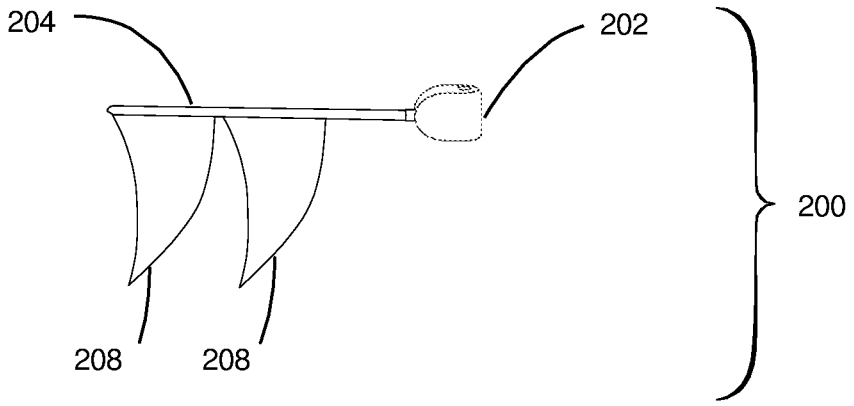
FIG. 2A depicts an embodiment of the present invention that may be attached to the conventional ski pole assembly of FIG. 1.

FIG. 2A depicts a perimeter indication rod assembly 200 that may be attached to the conventional ski pole assembly 100 of FIG. 1, according to an example embodiment of the present invention. In the embodiment of FIG. 2A, the perimeter indication rod assembly 200 includes a pole clamp 202 and a perimeter indication rod 204 that is pivotally connected to the pole clamp 202. The pole clamp 202 is preferably clamped to the pole 102 between the handle 106 and the lower end 108.

In the embodiment of FIG. 2A, a distal extent (left end in the view of FIG. 2A) of the perimeter indication rod 204 visually indicates a desired lateral distance from the pole clamp 202. In the embodiment of FIG. 2A, the perimeter indication rod 204 optionally includes two visually conspicuous flags 208 that can help attract the attention of other skiers to the perimeter indication rod 204. Alternatively, the perimeter indication rod 204 includes structure such as channels, grooves, or snap features for mounting the flags 208. The flags 208 preferably but not necessarily include a color that is easily distinguishable from skiing terrain, e.g. not entirely white.

Figure 2C:
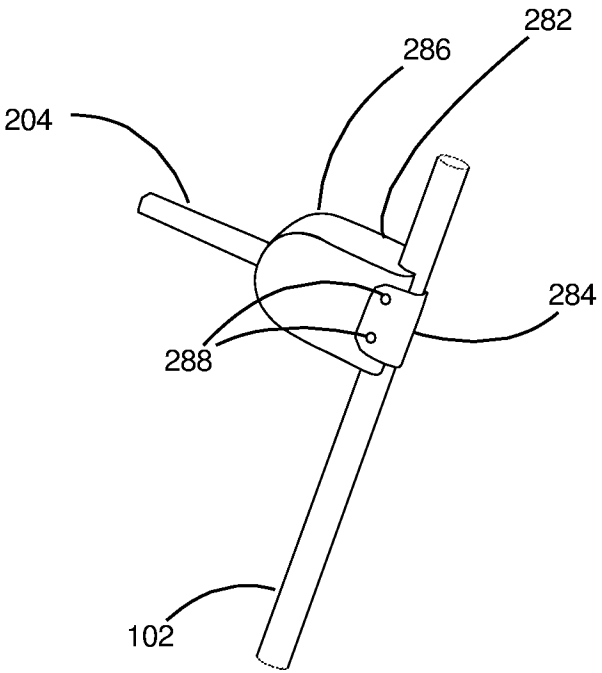
FIG. 2C depicts another example attachment embodiment.
Figure 2B:
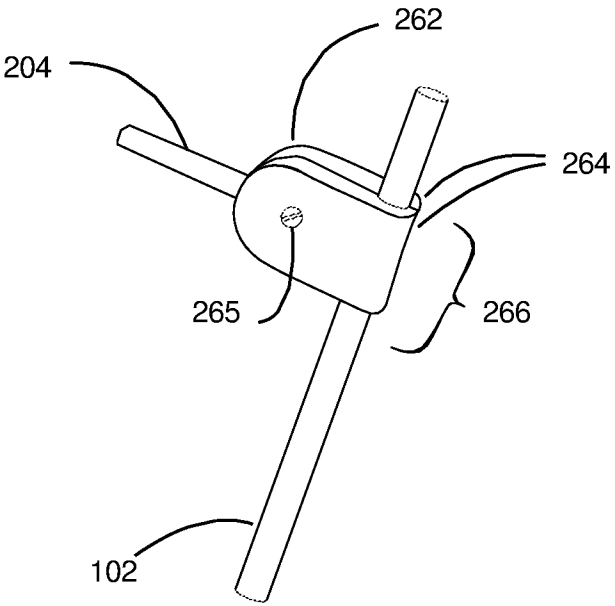
FIG. 2B depicts an example ski pole attachment embodiment.

FIG. 2B depicts an example method and apparatus for attachment of the perimeter indication rod assembly 200 to a ski pole 102. In the example embodiment of FIG. 2B, a clamp 262 comprises a clamshell mount 266 having two clamshell members 264 that encircle the pole 102. The clamshell members 264 can be separate subcomponents as shown, or could alternatively be integrally connected members of a single clamshell component having a similar overall shape to the clamshell mount 266.

In the embodiment of FIG. 2B, the clamshell members 264 define an inner pole receptacle therebetween that receives the pole 102. In the embodiment of FIG. 2B a single screw 265 is shown going through the two clamshell members 264, for tightening them around the inner pole receptacle. Alternatively (or in addition) a plurality of screws, rivets, or integral snap features could be used to tighten the clamshell members 264 around the pole 102. The clamshell members 264 may be made from or include a resilient material that could conform to the shape of the pole 102 and provide sufficient friction at the pole-clamp interface to reduce slippage. Alternatively a resilient or adhesive material may be provided at the pole-clamp interface to reduce slippage, such as foam rubber, glue, or double-sided adhesive tape.

FIG. 2C depicts another example attachment embodiment. In the embodiment of FIG. 2C, a clamp 282 comprises a side mount 286 that is attached to the pole 102 with a strap 284 and attachment points 288. In one embodiment the strap 284 or plurality of straps are made from a compliant rubber or similar material with sufficient stiffness and friction to reduce slippage at the mount-pole interface. The strap 284 may alternatively comprise a nylon or polyester fabric strap material tightened around the pole 102 by a conventional ratchet or buckle with mechanical advantage to make tensioning easy to accomplish for the skier.

Figure 3:
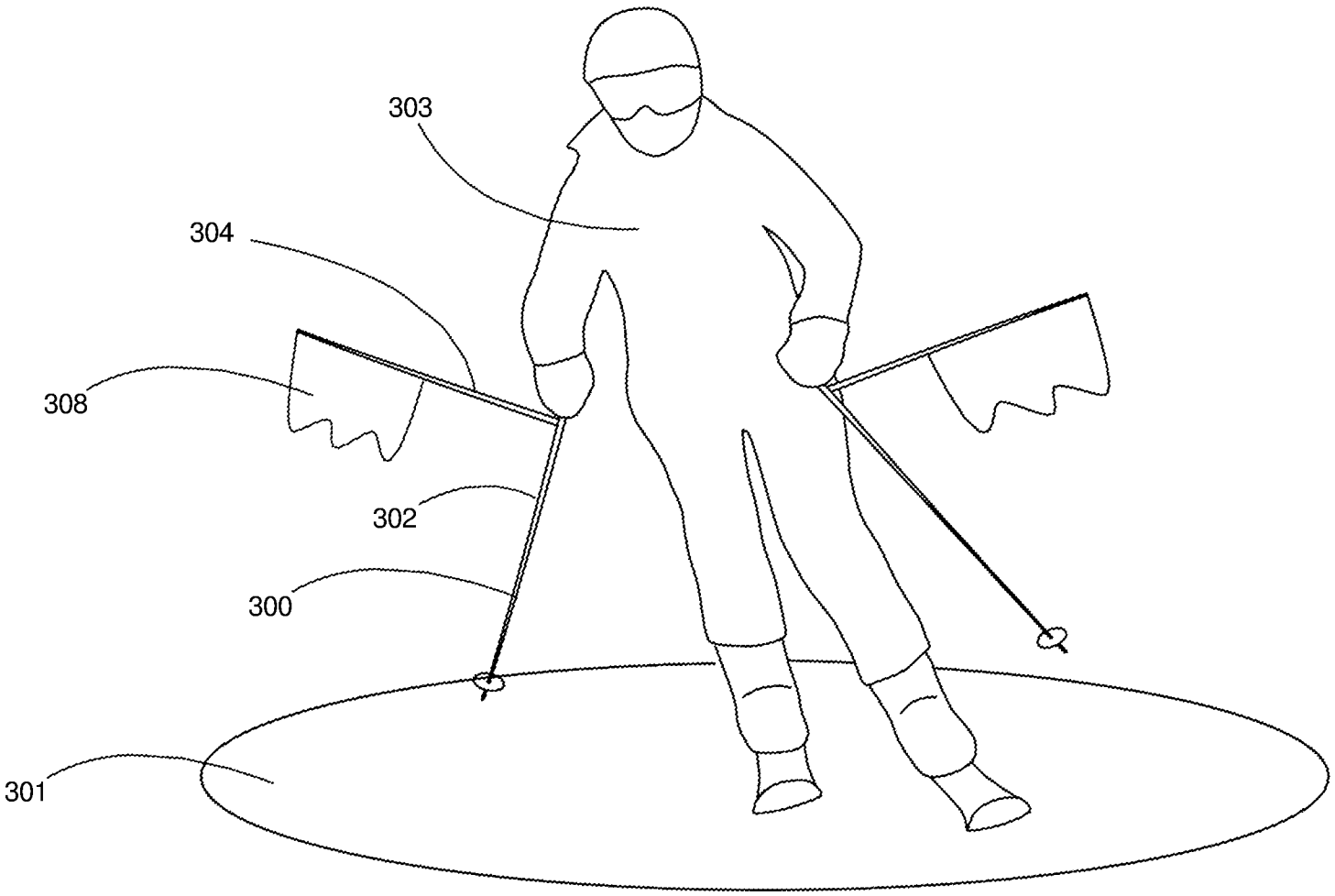
FIG. 3 depicts a skier using ski poles according to an example embodiment of the present invention.

FIG. 3 depicts a skier 303 using ski pole assemblies 300 according to an example embodiment of the present invention. In the embodiment of FIG. 3, each of the ski pole assemblies 300 includes a perimeter indication rod 304 that extends laterally from a pole 302. The distal extent of the perimeter indication rod 304 preferably visually indicates a lateral distance from the pole 302, and therefore from the skier 303, that is desired by the skier 303 as a safety margin for collision avoidance.

The desired safety margin may be conceptually considered to form a collision avoidance perimeter 301 around the skier 303, even though the lateral distance indication may be visible only at or under the location of the perimeter indication rods 304. For example, in the embodiment of FIG. 3, each perimeter indication rod 304 optionally includes a conspicuous flag 308 that can help attract the attention of other skiers to the perimeter indication rod 304. The flag 308 preferably but not necessarily includes a color that is easily distinguishable from skiing terrain, e.g. not entirely white.

Figure 4A:
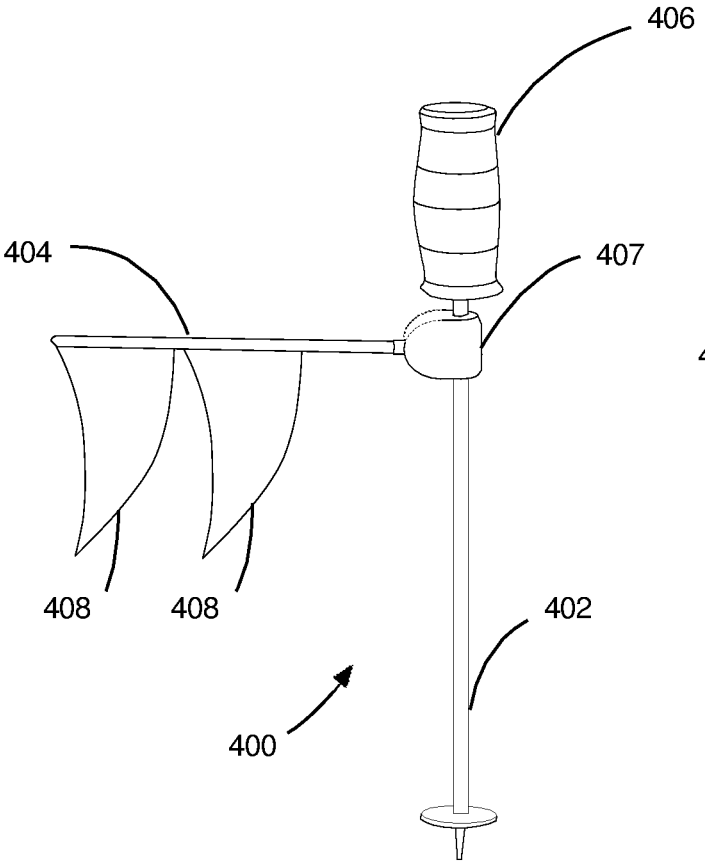
FIG. 4A depicts a ski pole according to an example embodiment of the present invention, with a safety perimeter indication rod extended.
Figure 4B:
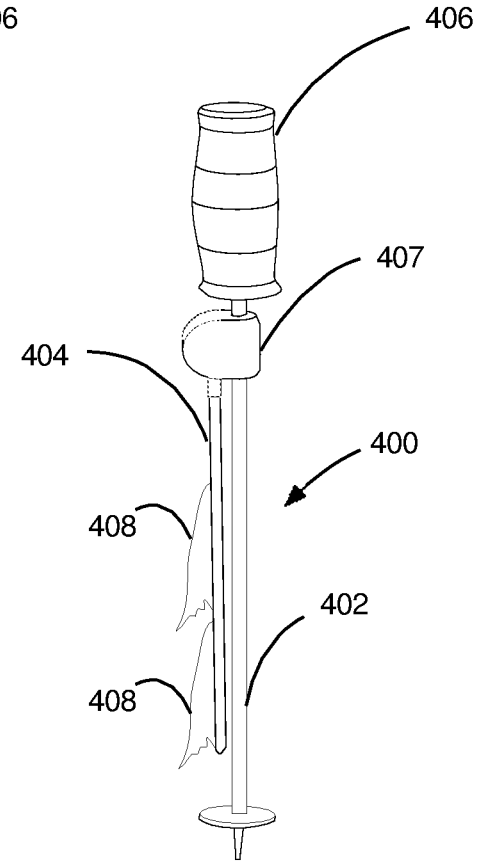
FIG. 4B depicts a ski pole according to the embodiment of FIG. 4A, except with the safety perimeter indication rod stowed in a retracted position.

FIG. 4A depicts a ski pole assembly 400 according to an example embodiment of the present invention, with a safety perimeter indication rod 404 rotated to an extended position. FIG. 4B depicts the ski pole assembly 400 with its safety perimeter indication rod 404 stowed in a retracted position. Now referring to FIGS. 4A and 4B, the ski pole assembly 400 includes a pole 402 and a handle 406 attached to an upper portion of the pole 402. The perimeter indication rod 404 optionally includes two visually conspicuous perimeter indicator flags 408.

In the embodiment of FIGS. 4A and 4B, the perimeter indication rod 404 is pivotally connected to the pole 402 by a rod positioning mechanism 407. The rod positioning mechanism preferably selectively holds the perimeter indication rod 404 in at least two angular positions, including an extended position as shown in FIG. 4A, and a retracted or stowed position as shown in FIG. 4B.

Figure 5A:
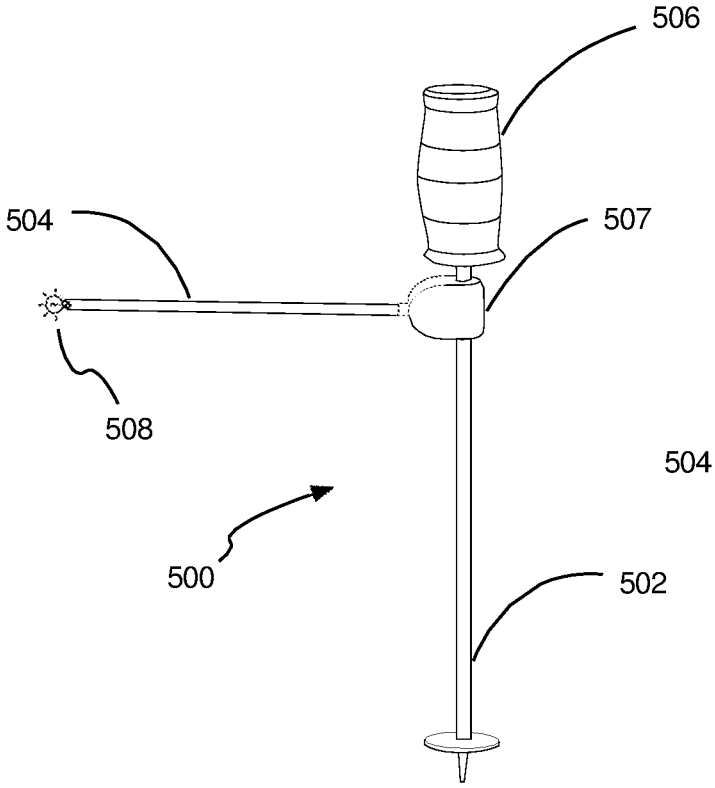
FIG. 5A depicts a ski pole according to another example embodiment of the present invention, with a safety perimeter indication rod extended.
Figure 5B:
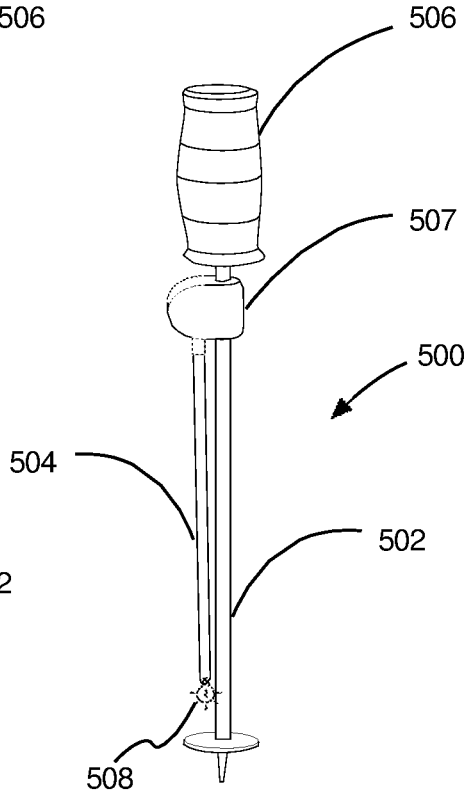
FIG. 5B depicts a ski pole according the embodiment of FIG. 5A, except with the safety perimeter indication rod stowed in a retracted position.

FIG. 5A depicts a ski pole assembly 500 according to an example embodiment of the present invention, with a safety perimeter indication rod 504 rotated to an extended position. FIG. 5B depicts the ski pole assembly 500 with its safety perimeter indication rod 504 stowed in a retracted position. Now referring to FIGS. 5A and 5B, the ski pole assembly 500 includes a pole 502 and a handle 506 attached to an upper portion of the pole 502. In the embodiment of FIGS. 5A and 5B, the perimeter indication rod 504 is pivotally connected to the pole 502 by a rod positioning mechanism 507. The rod positioning mechanism preferably selectively holds the perimeter indication rod 504 in at least two angular positions, including an extended position as shown in FIG. 5A, and a retracted or stowed position as shown in FIG. 5B.

In the embodiment of FIGS. 5A and 5B, the perimeter indication rod 504 optionally includes a visually conspicuous perimeter indicator light 508, or a plurality of such lights. In certain embodiments, the perimeter indicator light 508 may be a steadily illuminated or blinking LED light. Alternatively, or in addition, the perimeter indication rod 504 may include a downward-directed laser that can illuminate or partially illuminate a desired safety perimeter (e.g. a portion of the safety perimeter 301 shown in FIG. 3) on the snow surface below, preferably spaced outside of the skier, outside of the lower end of the pole 502, and/or outside of the pole clamp (e.g. the pole clamp 202 of FIG. 2A) by a lateral distance corresponding to the safety margin desired by the skier.

Figure 6B:
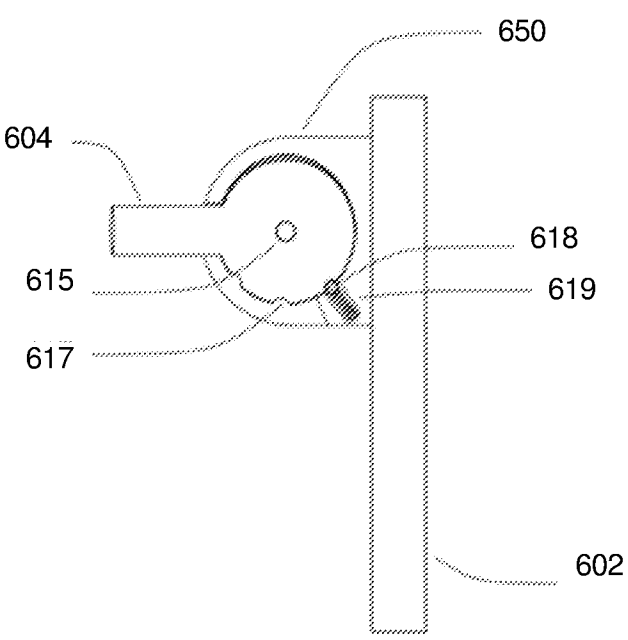
FIGS. 6A and 6B show clocking detent mechanisms to enable selective manual positioning of a safety perimeter indication rod relative to the ski pole, according to two example embodiments of the present invention.
Figure 6A:
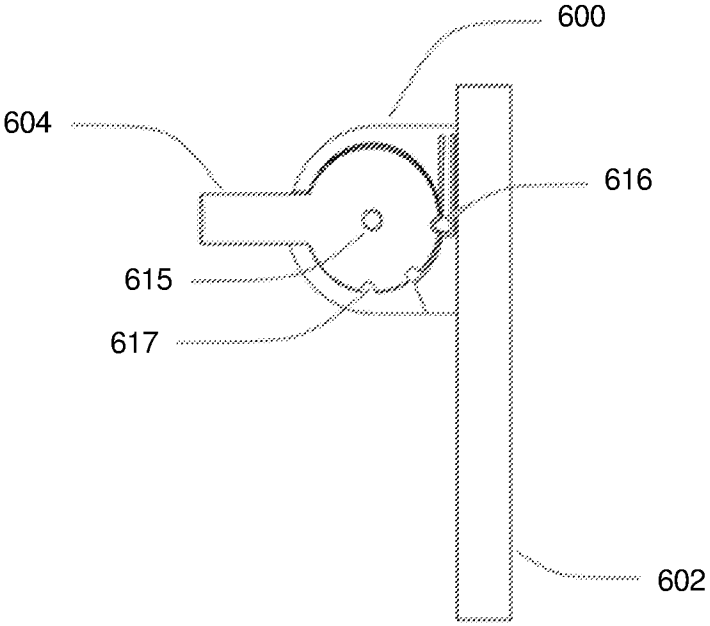

FIGS. 6A and 6B show cut-away views of alternative rod positioning mechanisms 600 and 650, respectively. The rod positioning mechanisms 600 and 650 enable selective manual positioning of a safety perimeter indication rod 604 relative to a ski pole 602, according to two example embodiments of the present invention. In the embodiments of FIGS. 6A and 6B, the rod positioning mechanisms 600 and 650 each include three clocking detents 617 corresponding to an extended position, an intermediate position, and a stowed position of the perimeter indication rod 604.

In the embodiment of FIG. 6A the rod positioning mechanism 600 may comprise a resilient material in which a cantilevered beam forming a pawl 616 has been integrally formed, for example by etching or injection molding. The pawl 616 may engage with a corresponding one of the detents 617 to hold the perimeter indication rod 604 in a selected one of extended, intermediate, or stowed angular positions. Specifically, the perimeter indication rod 604 may rotate about a conventional pivot 615 (e.g. a shaft, an injection-molded protrusion, etc.), for angular positioning relative to the pole 602. The skier must manually overcome the position retention force of the interface between the pawl 616 and the corresponding detent 617 to change the angular position of the perimeter indication rod 604.

In the embodiment of FIG. 6B the rod positioning mechanism 650 is similar to the rod positioning mechanism 600 except the integrally-formed pawl 616 optionally has been replaced with a coil spring 619 and ball bearing 618. The ball bearing 618 is preloaded by the spring 619 to radially engage with a corresponding one of the detents 617 to hold the perimeter indication rod 604 in a selected one of extended, intermediate, or stowed angular positions.

Figure 7B:
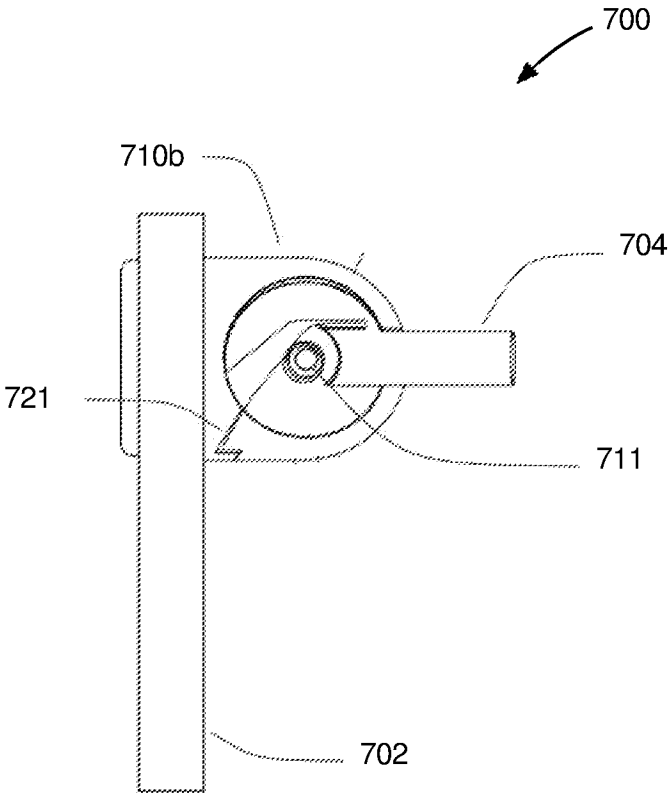
FIGS. 7A and 7B show two cut-away views of a torsional spring locking and release mechanism to enable selective deployment and stowing of a safety perimeter indication rod on a ski pole, according to an example embodiment of the present invention.
Figure 7A:
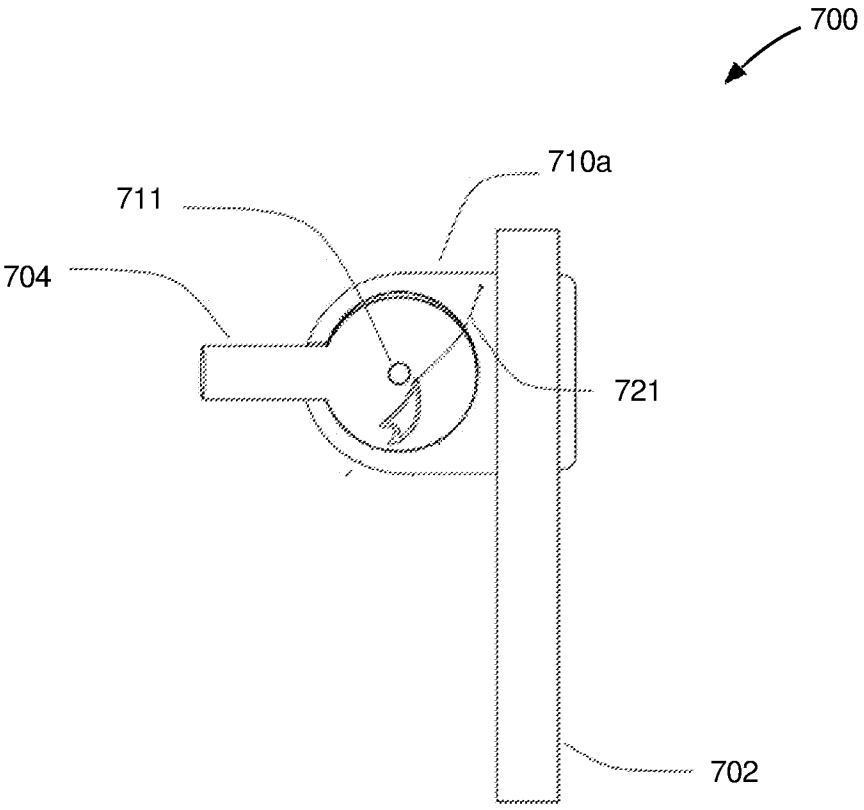

FIGS. 7A and 7B show two cut-away views of a rod positioning mechanism 700 that comprises a torsional spring that urges deployment and stowing of a safety perimeter indication rod on a ski pole, according to an example embodiment of the present invention. FIG. 7A can be considered to depict a clamshell right half 710*a* and the left side of a perimeter indication rod 704, while FIG. 7B can be considered to depict a clamshell left half 710*b* and the right side of the perimeter indication rod 704.

A torsional spring 721 optionally may be a ribbon spring having bent ends that may be retained by and coupled to clamshell half 710*a* and to the perimeter indication rod 704. The torsional spring 721 may be configured, preloaded, and/or bent during installation to apply a reversable torque to the perimeter indication rod 704, for example by contact with an internal labyrinth groove in the perimeter indication rod 704, and an anchor in the clamshell half 710*a*. Specifically, the torsional spring 721 may be bent into a Z shape with one end anchored in the clamshell half 710*a* and the other end alternately gliding or catching inside the labyrinth groove in the perimeter indication rod 704. The bent end of the spring 721 can then glide or catch within the labyrinth groove of the perimeter indication rod 704 as it is moved in the clockwise direction, with the sense of the bending of the torsional spring 721 reversing as it angularly shifts and a mid-span is pressed against a central pivot shaft 711. A similar but opposite torque inflection occurs when the perimeter indication rod is thereafter cycled in the counterclockwise direction. In this way, the torsional spring 721 can apply a torque to the perimeter indication rod 704 to maintain deployed or retracted positions, as it is angularly cycled therebetween manually by the skier.

Alternatively, the rod positioning mechanism may include a conventional torsional spring and a conventional latch for torsional locking and release, to enable selective deployment and stowing of a safety perimeter indication rod 704 relative to a ski pole 702. The torsional spring may be a conventional torsional spring that urges the perimeter indication rod towards an extended position in certain embodiments, or alternatively towards a retracted position in certain other embodiments.

If the conventional torsional spring is configured or preloaded to urge the perimeter indication rod towards an extended position, then the skier need only release the conventional latch to deploy the perimeter indication rod 704 to the extended position, with action against the spring required only when stowing the perimeter indication rod 704. Such embodiments may be more convenient for the skier after disembarking from a chair lift and before starting a downhill run.

Alternatively, if the conventional torsional spring is configured or preloaded to urge the perimeter indication rod 704 towards a stowed position, then the skier need only release the conventional latch to retract the perimeter indication rod 704 to the stowed position, with action against the spring required only when extending the perimeter indication rod 704. Such embodiments may be more convenient for the skier after completing a downhill run, and before entering a queue for ascending the mountain again on a chair lift.

Figure 8B:
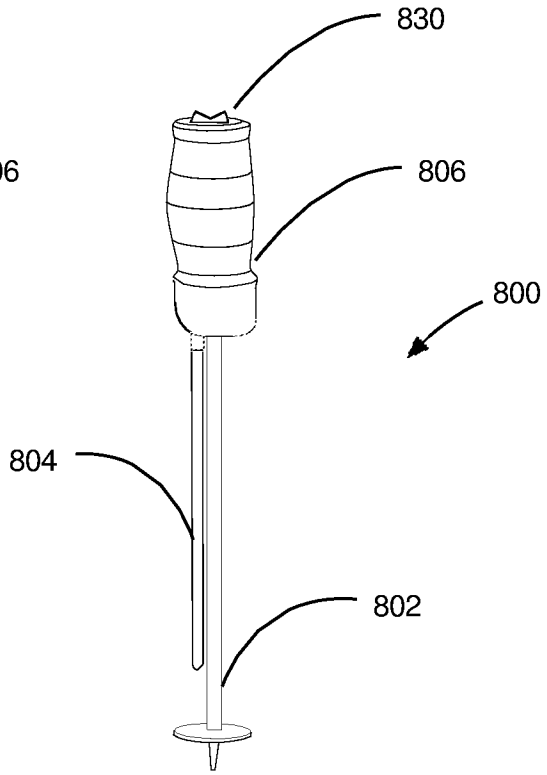
FIG. 8B depicts a ski pole according the embodiment of FIG. 8A, except with the safety perimeter indication rod stowed in a retracted position.
Figure 8A:
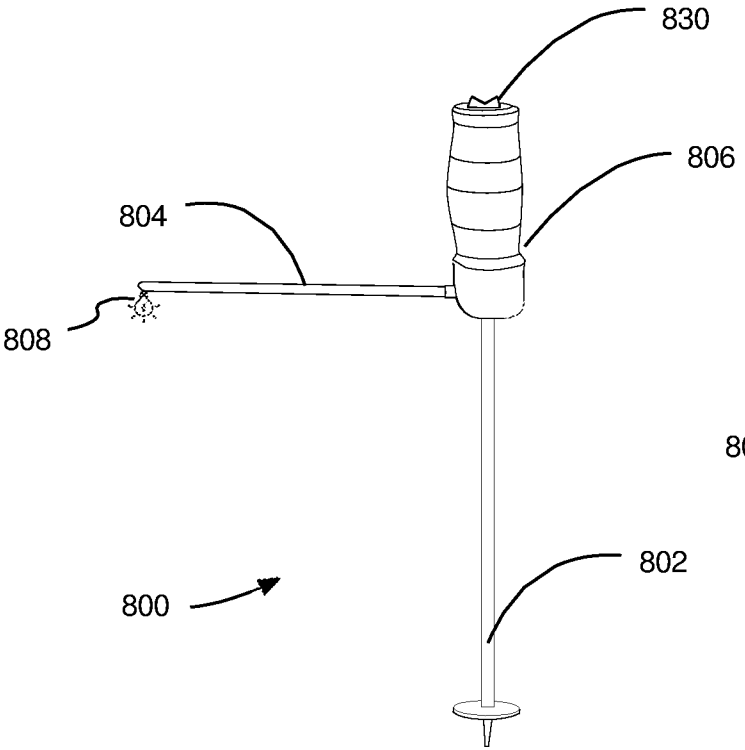
FIG. 8A depicts a ski pole according to an example embodiment of the present invention, with a safety perimeter indication rod extended.
Figure 8C:
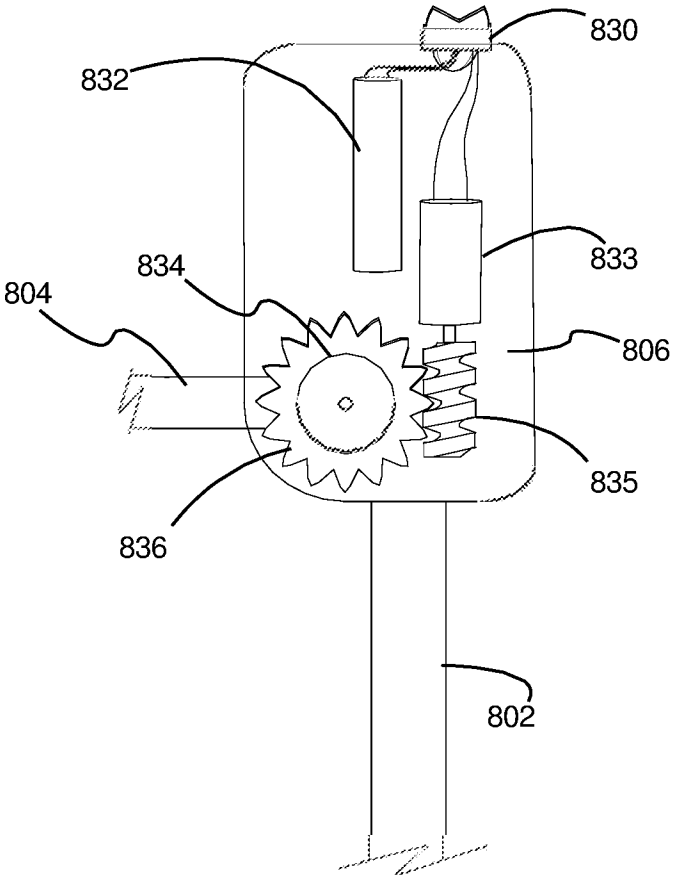
FIG. 8C is an interior cut-away view of an example handle assembly of the ski pole of FIG. 8A.

FIG. 8A depicts a ski pole assembly 800 according to an example embodiment of the present invention, with a safety perimeter indication rod 804 extended. FIG. 8B depicts the ski pole assembly 800 with the safety perimeter indication rod 804 stowed in a retracted position. FIG. 8C is an interior cut-away view of an example handle assembly 806 of the ski pole assembly 800. Now referring to FIGS. 8A, 8B, and 8C, the ski pole assembly 800 includes a pole 802 and a handle assembly 806 attached to an upper portion of the pole 802.

In the embodiment of FIGS. 8A, 8B, and 8C, the perimeter indication rod 804 is pivotally connected to the pole 802 by a rod positioning mechanism that is built into the handle assembly 806. The rod positioning mechanism preferably selectively holds the perimeter indication rod 804 in at least two angular positions, including an extended position as shown in FIG. 8A, and a retracted or stowed position as shown in FIG. 8B.

In the embodiment of FIGS. 8A, 8B, and 8C, the perimeter indication rod 804 optionally includes a visually conspicuous perimeter indicator light 808, or a plurality of such lights. In certain embodiments, the perimeter indicator light 808 may be a steadily illuminated or blinking LED light. Alternatively, or in addition, the perimeter indication rod 804 may include a downward-directed laser that can illuminate or partially illuminate a desired safety perimeter (e.g. a portion of the safety perimeter 301 shown in FIG. 3) on the snow surface below, preferably spaced outside of the skier and outside of the lower end of the pole 802, by a lateral distance corresponding to the safety margin desired by the skier.

In the embodiment of FIG. 8C the rod positioning mechanism of the handle assembly 806 includes a conventional electric motor 833 coupled to the perimeter indication rod 804 by a worm gear 835 and a gear 836 being concentric with the pivot. Specifically, in the embodiment of FIG. 8C, the worm gear 835 may be directly driven by the electric motor 833, and the concentric gear 836 may be fixed to the perimeter indication rod 804. The electric motor 833 may be controlled by a switch 830, disposed on an outer surface of the handle assembly 806.

In certain embodiments, the switch 830 may be a conventional rocker switch that connects a conventional battery 832 to the motor 833 with opposite voltage polarity depending upon which way the rocker switch is depressed. Motor 833 optionally may be designed to run until stalled without damage eliminating the need for limit switches. A clutch 834 may be included to allow slippage between the perimeter indication rod 804 and the concentric gear 836 to prevent damage in case the perimeter indication rod 804 is forced (e.g. if the skier falls while the perimeter indication rod 804 is extended, and a large torque is thereby applied by the environment to the perimeter indication rod 804).

In certain embodiments, the rod positioning mechanism of the handle assembly 806 may be automated to further include limit detection and automatic extension and retraction after a short tap of switch 830, or various colors and flashing patterns for lights including the light 808.

In the foregoing specification, the invention is described with reference to specific exemplary embodiments, but those skilled in the art will recognize that the invention is not limited to those. For example, the word "preferably" is used herein to consistently include the meaning of "not necessarily" or optionally. "Comprising," "including," and "having," are intended to be open-ended terms. It is also contemplated that various features and aspects of the invention may be used individually or jointly and possibly in a different environment or application, and various changes in form and detail may be made without departing from the spirit and scope of the invention. The specification and drawings are, accordingly, to be regarded as illustrative and exemplary rather than restrictive, and the invention should be limited only according to the following claims, including all equivalent interpretation to which they are entitled.

We claim:

1. A ski pole, comprising:

a pole having an upper portion and a lower end;

a handle attached to the upper portion of the pole; and a perimeter indication rod pivotally connected to the pole by a rod positioning mechanism;

wherein the rod positioning mechanism is configured to selectively hold the perimeter indication rod in at least two angular positions, the least two angular positions including an extended position and a stowed position; and wherein the distal extent of the perimeter indication rod visually indicates a desired lateral distance from the pole.

2. The ski pole of claim 1 wherein the perimeter indication rod includes a visually conspicuous perimeter indicator selected from the group consisting of a flag, a light, and a colored paint coating that is not entirely white.

3. The ski pole of claim 2 wherein the light is selected from the group consisting of a steadily illuminated LED light, a blinking LED light, and a downward-directed laser.

4. The ski pole of claim 3 wherein the downward-directed laser illuminates a desired perimeter outside of the lower end of the pole.

5. The ski pole of claim 1 wherein the rod positioning mechanism includes at least two clocking detents corresponding to the extended position and the stowed position.

6. The ski pole of claim 1 wherein the rod positioning mechanism includes a torsional spring that urges the perimeter indication rod towards the extended position.

7. The ski pole of claim 1 wherein the rod positioning mechanism includes a torsional spring that urges the perimeter indication rod towards the retracted position.

8. The ski pole of claim 1 wherein the rod positioning mechanism is clamped to the pole between the handle and the lower end.

9. The ski pole of claim 1 wherein the handle includes the rod positioning mechanism.

10. The ski pole of claim 1 wherein the rod positioning mechanism includes an electric motor coupled to the perimeter indication rod by a plurality of gears, at least one of the plurality of gears being concentric with the pivot.

11. The ski pole of claim 10 wherein the plurality of gears includes a worm gear, the worm gear is driven by the electric motor, and the concentric gear is fixed to the perimeter indication rod.

12. The ski pole of claim 10 wherein the electric motor is controlled by a switch on an outer surface of the handle.

13. A perimeter indication rod assembly that is attachable to a conventional ski pole, the perimeter indication rod assembly comprising;

a pole clamp;

a perimeter indication rod pivotally connected to the pole clamp by a rod positioning mechanism;

wherein the rod positioning mechanism is configured to selectively hold the perimeter indication rod in at least two angular positions, the least two angular positions including an extended position and a stowed position; and wherein the distal extent of the perimeter indication rod visually indicates a desired lateral distance from the pole clamp.

14. The perimeter indication rod assembly of claim 13 wherein the perimeter indication rod includes a visually conspicuous perimeter indicator selected from the group consisting of a flag, a light, and a colored paint coating that is not entirely white.

15. The perimeter indication rod assembly of claim 14 wherein the light is selected from the group consisting of a steadily illuminated LED light, a blinking LED light, and a downward-directed laser.

16. The perimeter indication rod assembly of claim 15 wherein the downward-directed laser illuminates a desired perimeter outside of the pole clamp.

17. The perimeter indication rod assembly of claim 13 wherein the rod positioning mechanism includes at least two clocking detents corresponding to the extended position and the stowed position.

18. The perimeter indication rod assembly of claim 13 wherein the rod positioning mechanism includes a torsional spring that urges the perimeter indication rod towards the extended position.

19. The perimeter indication rod assembly of claim 13 wherein the rod positioning mechanism includes a torsional spring that urges the perimeter indication rod towards the retracted position.

20. The perimeter indication rod assembly of claim 13 wherein the pole clamp comprises first and second clam shell members that defining an inner pole receptacle therebetween, and at least one fastener that tightens the first and second clam shell members around the inner pole receptacle.

* * * * *